United States Patent [19]

Quinlan

[11] Patent Number: 4,846,332

[45] Date of Patent: Jul. 11, 1989

[54] COUNTERFEIT COIN DETECTOR CIRCUIT

[75] Inventor: Thomas Quinlan, Wilton, Conn.

[73] Assignee: Automatic Toll Systems, Inc., Mt. Vernon, N.Y.

[21] Appl. No.: 162,190

[22] Filed: Feb. 29, 1988

[51] Int. Cl.[4] ..... G07D 5/08

[52] U.S. Cl. ..... 194/317

[58] Field of Search ..... 194/317, 318, 319

[56] References Cited

U.S. PATENT DOCUMENTS

| | | | |
|---|---|---|---|
| 3,481,443 | 12/1969 | Meloni . | |
| 3,901,368 | 8/1975 | Klinger . | |
| 4,128,158 | 12/1978 | Dautremont et al. . | |
| 4,234,071 | 11/1980 | LeHong . | |
| 4,254,857 | 3/1981 | Levasseur et al. | 194/319 |
| 4,275,806 | 6/1981 | Tanaka et al. . | |
| 4,361,218 | 11/1982 | Van Dort . | |
| 4,431,014 | 2/1984 | Yokomori . | |
| 4,460,003 | 7/1984 | Barnes et al. | 194/317 X |
| 4,460,080 | 7/1984 | Howard . | |
| 4,538,719 | 9/1985 | Gray et al. | 194/317 |
| 4,625,852 | 12/1986 | Hoorman | 194/317 |

*Primary Examiner*—F. J. Bartuska

*Attorney, Agent, or Firm*—Lee C. Robinson, Jr.

[57] ABSTRACT

A counterfeit coin detector circuit comprising an constant frequency and voltage maxima and minima square wave oscillator input to a tank circuit including an inductive probe and an adjustable capacitance. The tank circuit is driven at a fixed and stable frequency and has a variable peak to peak AC output voltage amplitude which is a function of the characteristics of the coin under test. The AC output of the tank circuit is converted to a DC voltage correlated to the peak to peak AC ouput from the tank circuit. A group of window detector circuits are employed to determine whether the DC voltage output falls within certain preset ranges corresponding to the presence of particular coins. The presence or absence of a window detect can be used to accept or reject the coin or to otherwise take appropriate action with respect to the coin under test. The circuit is capable of being retrofitted into standard toll booth coin collecting systems and provides a simple and very rugged circuit for detecting counterfeit coins or slugs which is also very temperature stable.

6 Claims, 1 Drawing Sheet

COUNTERFEIT COIN DETECTOR CIRCUIT

FIELD OF THE INVENTION

This invention relates to the field of electronic circuits which are used to distinguish between genuine and counterfeit coins. More particularly it relates to coin testing circuits particularly well adapted for use in high speed automatic toll collecting systems on roadways.

BACKGROUND OF THE INVENTION

Distinguishing automatically between genuine U.S. coins and other objects such as foreign coins, counterfeit coins, and metallic slugs is of great importance in devices such as coin operated vending machines and automatic toll booths, as well as in many other, similar devices.

Many methods have been suggested to accomplish the task of distinguishing genuine coins from counterfeit ones. A number of these methods rely on purely mechanical devices which both weigh the coin and measure its physical dimensions. Such devices generally operate relatively slowly, which may be a problem if the device is required to operate in a high-volume, high speed area. Additionally, the capability of such devices to detect well made counterfeits is limited. Finally, a mechanical device, due to size limitations and relative mechanical complexity, can only operate upon and distinguish between counterfeit and genuine coins for a limited number of coin types.

Various electrical methods have also been suggested to distinguish between counterfeit and genuine coins. Many of these involve the use of an inductive coil which forms part of an electromagnetic "tank" circuit. When a metallic coin-shaped object passes through the magnetic field of the inductive coil, the inductance and hence the circuit's resonance changes, depending upon coin size, composition and magnetic permeability. These changes can be detected by "ringing" (periodically applying a voltage to the circuit) the resonant circuit when a coin-like object is present to produce a damped resonant waveform output. A comparison between the resultant decaying waveform in frequency and/or decay characteristics with stored values for genuine coins allows the circuit to distinguish the genuine coins from the counterfeit.

Existing counterfeit coin detector circuits have several problems. The first is that the sensing circuit is generally quite susceptible to variations in temperature. Thus, as temperature changes, genuine coins may be determined to be counterfeit, or counterfeit coins may go undetected. This is a particular problem in coin detectors which must operate in an outdoor environment, such as automatic toll collecting systems for roadways.

Another problem is that most counterfeit coin detector circuits can only validate a limited number of different types of coins. In an area adjacent to a national border, where two different sets of coins may appear relatively frequently, this limitation can be quite troublesome. Finally, the purely analog nature of these circuits requires relatively frequent calibration over the lifetime of the circuit; not merely to correct the effects of temperature changes, but also to compensate for wear on the mechanical portions of the equipment, humidity, etc.

Thus, there is a need for a counterfeit coin detector circuit which can validate many different types of coins, which can operate very rapidly with a very low error rate in a relatively harsh, outdoor environment, that is simple and rugged, which requires very little, if any, calibration and which is highly temperature independent.

OBJECTS OF THE INVENTION

It is an object of this invention to provide a coin testing circuit which can rapidly and accurately distinguish between many different types of coins and their counterfeit imitations.

It is another object of this invention to provide a coin testing circuit which can be retrofitted into standard toll collecting systems.

Yet another object of this invention is to provide a coin testing circuit which is extremely rugged and which will be capable of continuous, trouble-free operation under stressful environmental conditions.

It is another object of this invention to provide a coin testing circuit which can be driven at a precisely controlled and constant frequency and amplitude.

Still another object of this invention is to distinguish coins and counterfeit objects using a digital logical circuit.

Yet another object of this invention is to provide a coin testing circuit which will require little, if any, calibration during its operational lifetime.

Still another object of the invention is to provide a coin testing circuit which can be easily adjusted to distinguish between different types of coins than the circuit was originally set to detect.

Further objects and advantages of the invention will be apparent from the following detailed description of a preferred embodiment thereof.

SUMMARY OF THE INVENTION

In accordance with a preferred embodiment of the present invention, a coin testing circuit is provided which has means for generating a square wave voltage of substantially constant frequency and amplitude. This means includes an output which is operatively connected to the input of a resistor. The resistor further has an output end. The circuit further includes a probe tank circuit. The probe tank circuit includes a capacitor and an inductor connected in parallel to eachother. The inductor is positioned in magnetic field relationship with a coin to be tested. The probe tank circuit is operatively connected to the output of the resistor. Means for generating a direct current voltage output correlated in value to the amplitude of the voltage at the operative connection of the probe tank circuit to the output of the resistor and means for determining whether the direct current voltage output has a value less than a first predetermined voltage value and greater than a second predetermined voltage value at a particular time are also provided.

BRIEF DESCRIPTION OF THE DRAWING

The following detailed description, given by way of example and not intended to limit the present invention solely to the embodiments shown and described herein, will best be understood in conjuction with the accompanying drawing in which.

DETAILED DESCRIPTION

Figure 1:
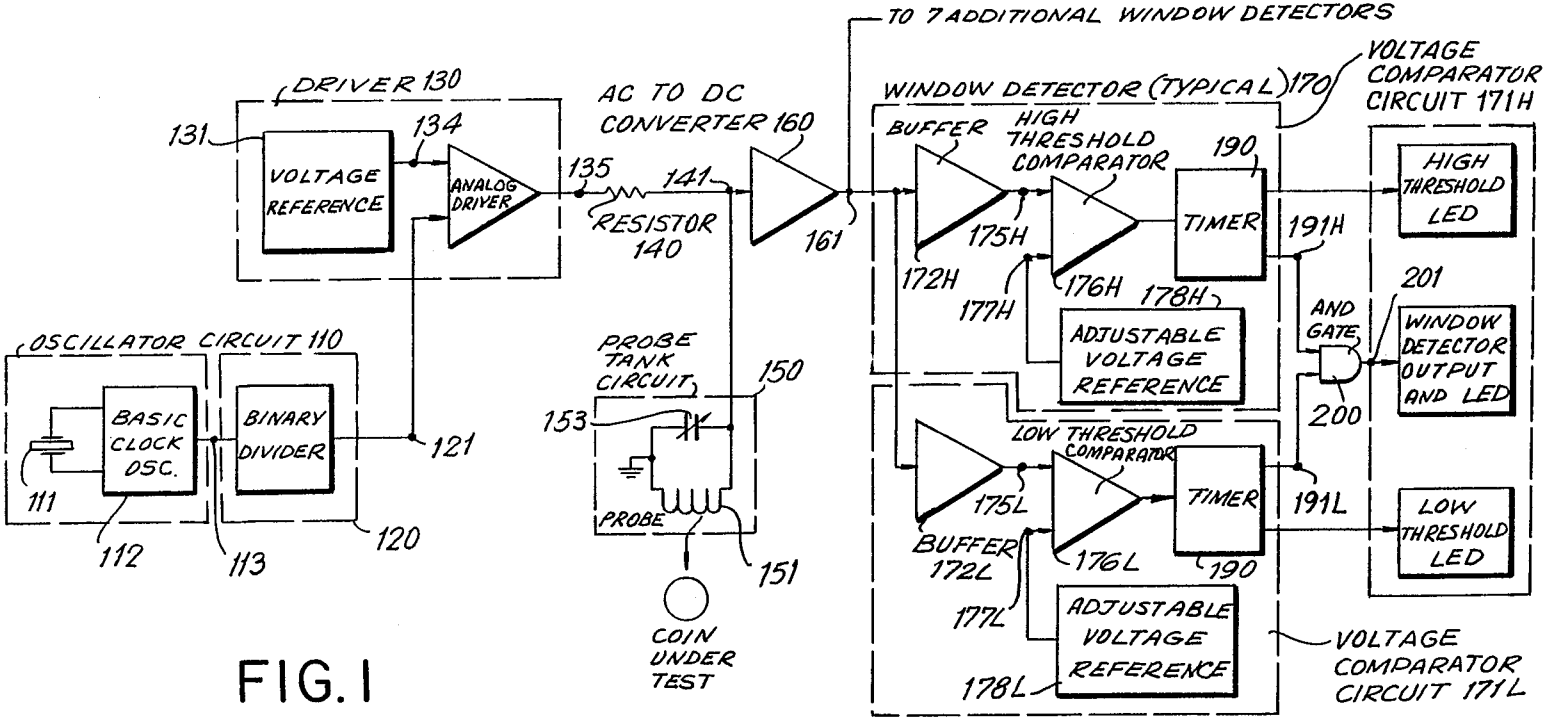
FIG. 1 is a schematic drawing of a preferred embodiment of the coin testing circuit of the present invention.

Referring now to FIG. 1 in detail, a preferred embodiment of a counterfeit coin detector circuit is depicted in schematic form. This circuit includes oscillator circuit 110, which is adapted to provide a sinusoidal wave with constant amplitude and frequency. Oscillator circuit 110 is preferrably constructed of an oscillator 112 controlled by a quartz crystal 111, or other stable, high frequency oscillator. Such a circuit is known to the art and can be constructed from either discrete components or from integrated circuits.

In the preferred embodiment of the present invention, oscillator circuit 110 preferably provides a sinusoidal wave output with a frequency of 2.45 MHz at the output 113. The exact frequency used is not critical as long as it remains very stable and is of sufficiently high frequency to avoid degradation by low frequency AC noise.

A binary divider 120 is connected to the output 113 of oscillator circuit 110. Binary divider circuit 120 is adapted to convert the high frequency sinusoidal wave produced by oscillator 110 into a square wave with a 50% duty cycle at output 121. In the preferred embodiment, the binary divider includes a frequency divider such as a 14040 frequency divider integrated circuit chip, and produces an output frequency of 19.2 KHz and a voltage swing of 0 to 12 volts. Frequency divider circuits are conventional and well known in the art. In a preferred embodiment of the present invention, the voltage output of the frequency divider is then input to a comparator circuit of conventional design (not shown) which is adapted to shift the voltage level of the square wave provided by frequency divider from 0V/+12V to +12 V/−12V at the output 121 of the binary divider 120.

The counterfeit coin detector circuit of the present invention also includes a driver circuit 130 for the tank circuit. Driver 130 includes a voltage reference 131 and an analog driver or amplifier 132. The analog driver 132 has a first input coupled to the output 121 of the binary divider and a second input coupled to an output 134 of the voltage reference 131.

Voltage reference 131 should be stable and relatively free of influence of temperature. Such stable voltage references can be constructed of conventional components and are of well known construction. In the present invention, an MC1504 voltage reference outputting through an adjustable voltage divider network is used. The adjustable resistor network permits precise adjustment of the output voltage to the desired value during calibration. Once the output voltage is calibrated, the output voltage of the voltage reference circuit 131 at output 134 will be stable and very independent of changes due to temperature.

The other input of the analog driver 132 coupled to the output 121 of the binary divider circuit 120. The analog driver 132 combines the output 121 from the binary divider circuit 120 with the precisely controlled and stable voltage output 134 from the voltage reference 131 to produce a square wave AC output at 135 of 50% duty cycle having a stable maximum and minimum voltage and equal positive and negative deflection controlled by the voltage output 134 from the voltage reference 131. In a preferred embodiment of the present invention, the output voltage from the analog driver is ±6.4V, but other voltages can also be employed.

The coin testing circuit of the present invention also includes a probe tank circuit 150, consisting of an inductor probe 151 connected in parallel to an adjustable capacitor circuit 153. Inductor probe 151 is positioned to magnetically interact with the coin under test. Since the overall inductance of inductor probe/coin combination is affected by the size, composition and magnetic permeability of the coin under test, the overall inductance of the probe/coin is a unique function of the characteristics of the coin under test.

Adjustable capacitor circuit 153 is preferrably a bank of fixed capacitance capacitors switchably connected in parallel to one another. During calibration of the coin testing circuit, various capacitors can be connected or disconnected until the desired overall capacitance appropriate for the coins to be tested is obtained. By selectively placing any one or a combination of several of its capacitors in parallel with the probe, the proper resonant frequency of the probe circuit can be established. The capacitance should be adjusted so that the natural resonant frequency of the probe tank circuit is close to the frequency of the output from the analog driver 132.

To differentiate the stable, fixed frequency, constant maxima and minima voltage square wave output 135 from the analog driver 132 from the fixed frequency, but variable voltage output from the probe tank circuit, a resistor 140, preferably having a resistance in the range of 15K ohms, is interposed between output 135 and output 141. Since inductor probe 151 of the probe tank circuit 150 has an inherent internal resistance, inductor 151 functions as one resistor of a voltage divider network which includes resistor 140 to divide the voltage at 135 in proportion to the resistance of resistor 141 and the resistance of the inductor 151.

Since the probe tank circuit is forceably driven at a fixed frequency, the output frequency of the signal at 141 will be the same frequency as the frequency of the signal at 135. However, the amplitude of the voltage output at 141 from the tank circuit 150 will vary depending upon the overall inductance of the tank circuit which, in turn, is a unique function of the characteristics of the coin under test.

The voltage output at 141 of the probe tank circuit is input to a circuit 160 adapted to convert the AC output of the probe tank circuit to a DC signal at output 161 which is correlated in amplitude to the peak to peak amplitude of the AC signal at 141. In the preferred embodiment of the present invention, a charge-coupled precision DC rectifier is used as circuit 160, which is commercially available from a number of sources. Alternatively, a root means square converter circuit can be employed. By "correlated" is meant that the DC output at 161 is a unique function of the peak to peak amplitude of the signal at 141. It is not necessary, however, that the DC voltage at 161 be equal to the peak to peak voltage amplitude at 141 or even linearly proportional to it. It is only necessary that the DC output at 161 be a unique function of the AC output at 141. Because the AC output at 141 is a unique function of the characteristics of the coin under test, the value of the DC output at 161 will be a unique function of the characteristics of the coin under test.

The DC output at 161 is input to a plurality of window detector circuits 170 connected in parallel to one another. Each of the window detector circuits includes a low threshold comparator adapted to provide a signal when the DC signal at 161 is greater than a minimum preset reference voltage value and a high threshold comparator adapted to provide a signal when the voltage is less than a preset maximum reference voltage value. The maximum and minimum voltage values for each window detector are set during calibration to correspond to the presence of a coin of a particular type at the inductor probe 151. In the present invention, eight window detector circuits are employed, corresponding to eight different coin types to be differentiated. The construction of all the window detector circuits is essentially the same, differing only in the values of the reference voltages set during calibration.

Each window detector 170 includes two voltage comparator circuits 171H and 171L connected in parallel, 171L being for determinating whether the voltage is greater that the preset minimum voltage, and the 171H being for determining whether the voltage is less than a preset maximum voltage. Since the construction of circuit 171L and 171H is the same (differing only in the setting of the voltage reference value), only 171L need be described.

Comparator circuit 171L preferably includes an input buffer 172L having an input at 161 and an output at 175L. Buffer 172L preferably includes a voltage follower amplifier of conventional construction. Buffer 172L thus amplifies the input voltage at 161, isolating the detecting circuitry from the feedback from the logic circuits and electromechanical relays and filtering out noise from the DC signal at 161 produced by the charge-coupled precision DC rectifier of circuit 160.

Buffer 172L outputs to one input 175L of a voltage comparator 176L of conventional construction. The other input 177L of the comparator 176L is connected to the output of an adjustable voltage reference 178L. Adjustable voltage reference 178L is preferably constructed of a precision voltage reference source which is highly stable and temperature compensated and an adjustable voltage divider network so that the desired output voltage at 177L can be conveniently preset to the desired minium voltage value during calibration. Such adjustable voltage sources well known in the art. Comparator 176L will have an output at 179L only when the value of the input at 175L exceeds the input at 177L, that is, when the value of the voltage at 175L exceeds the predetermined preset value.

The contruction of the voltage comparator circuit 171H is the same as for 171L, except that the adjustable voltage reference 178H is preset for a different, higher voltage value that 178L, and the voltage comparator 176H is connected so as to have an output at 179H when the input at 175H is less than the input at 177L. Of course, if desired, both comparator 176L and 176H can utilize the same precision voltage source with separately adjustable voltage divider networks.

Outputs 179L and 179H are fed, respectively, to timers 190L and 190H. Timers 190L and 190H clock the outputs at 191L and 191H to provide noise immunity and to make possible use of conventional downstream digital logic circuits. The clocked outputs 191L and 191H from the timers 190L and 190H (which should be timed to operate simultaneously) are coupled to the inputs of AND gate 200. Simultaneous presence of an output at 191L and 191H indicates that the voltage at 161 is between the preset maximum voltage and the preset minimum voltage. This results in an output signal at 201 corresponding to a window detect which, in turn, corresponds to the presence of a coin of a particular type at the inductor probe 151. The output signal at 201 can then be used to actuate indicating means such as a light emitting diode, or to actuate electromechanical devices to take appropriate action with respect to the coin under test, such as accepting the coin into a coin receiving hopper or rejecting the coin to coin return.

All the other window detectors operate identically, but have difference preset values of maximum and minimum voltages. In the present invention, eight window detectors are employed, but any number can be employed depending upon the number of coins that are desired to be discriminated.

As can be seen, the present invention provides a counterfeit coin detecting circuit which is simple, robust, highly independent of environmental temperature changes and thus well adapted to operate in an outdoor or other harsh environment.

The terms which have been used herein are terms of expression only to describe a preferred embodiment of the present invention and not of limitation. There is no intention in the use of such terms to exclude any equivalents of the present invention, which is defined by the appended claims.

What is claimed is:

1. A coin testing circuit comprising:

means for generating a square wave voltage of substantially constant frequency and amplitude, said means having an output;

a resistor having an output and an input, said input being operatively connected to the output of said means for generating a square wave voltage;

a probe tank circuit including a capacitor and an inductor connected in parallel to each other, said inductor being positioned in magnetic field relationship with a coin to be tested, said probe tank circuit having a first operative connection to the output of said resistor and a second operative connection to ground and generating an oscillatory output voltage at said first operative connection having a frequency equal to the frequency of said square wave and a peak to peak voltage amplitude which is a function of the characteristics of the coin under test;

means for generating a direct current voltage output correlated in value to the peak to peak amplitude of the voltage, said means being directly connected at the first operative connection of said probe tank circuit to the output of said resistor; and means for determining whether said direct current voltage output has a value less than a first predetermined voltage value and greater than a second predetermined voltage value at a particular time.

2. A coin testing circuit comprising:

means for generating a square wave voltage of substantially constant frequency and amplitude, said means including a clock oscillator, a binary divider, an amplifier and a voltage reference of substantially constant value, said clock oscillator having a voltage output of substantially constant frequency, said binary divider having an input operatively connected to the output of said clock oscillator and having a digital output of a substantially constant frequency which is a fraction of the frequency output of said clock oscillator, said amplifier having a first input operatively connected to the output of said binary divider, a second input operatively connected to the voltage reference, an output, and means for generating a voltage at said output having a substantially constant value in relation to the value of said voltage reference when a digital input is present at said first input;

a resistor having an output and an input, said input being operatively connected to the ouput of said amplifier;

a probe tank circuit including a capacitor and an inductor connected in parallel to each other, said inductor being positioned in magnetic field relationship with a coin to be tested, said probe tank circuit having an operative connection to the output of said resistor and having an oscillatory output voltage frequency equal to the frequency of the output of said binary divider and a peak to peak voltage which is a function of the characteristics of the coin under test;

means for generating a direct current voltage output correlated in value to the peak to peak amplitude of the voltage at the operative connection of said probe tank circuit to the output of said resistor; and means for determining whether said direct current voltage output has a value less than a first predetermined voltage value and greater than a second predetermined voltage value.

3. A coin testing circuit comprising:

means for generating a square wave voltage of substantially constant frequency and amplitude, said means having an output;

a resistor having an output and an input, said input being operatively connected to the output of said means for generating a square wave voltage;

a probe tank circuit including a capacitor and an inductor connected in parallel to each other, said inductor being positioned in magnetic field relationship with a coin to be tested, said probe tank circuit having an operative connection to the output of said resistor and having an oscillatory output voltage frequency equal to the frequency of said square wave input and a peak to peak voltage which is a function of the characteristics of the coin under test;

a charge-coupled precision DC rectifier having an input operatively connected to the operative connection of said probe tank circuit to the output of said resistor, said charge-coupled precision DC rectifier having an direct current output corresponding in value to the value of the peak to peak amplitude of the voltage at said input of said charge-coupled precision DC rectifier; and means for determining whether said direct current voltage output has a value less than a first predetermined voltage value and greater than a second predetermined voltage value.

4. A coin testing circuit comprising:

means for generating a square wave voltage of substantially constant frequency and amplitude, said means having an output;

a resistor having an output and an input, said input being operatively connected to the output of said means for generating a square wave voltage;

a probe tank circuit including a capacitor and an inductor connected in parallel to each other, said inductor being positioned in magnetic field relationship with a coin to be tested, said probe tank circuit having a first operative connection to the output of said resistor a second operative connection to ground, said first operative connection having an oscillatory output voltage frequency equal to the frequency of said square wave input and a peak to peak voltage which is a function of the characteristics of the coin under test;

means for generating a direct current voltage output correlated in value to the peak to peak amplitude of the voltage, said means being directly connected at the first operative connection of said probe tank circuit to the output of said resistor; and window detection means for determining whether said direct current voltage output has a value less than a first predetermined voltage value and greater than a second predetermined voltage value at a given instant of time, said means including a high threshold voltage comparator, a low threshold voltage comparator, a first voltage reference having an output of substantially constant value equal to said first predetermined voltage value, and a second voltage reference having an output of substantially constant value equal to said second predetermined voltage value;

said high threshold voltage comparator having a first input, said first input including means operatively connected to the operative connection of said probe circuit and to said output of said resistor, a second input operatively connected to the output of said first voltage reference, an output and means for generating a signal at said output when said first input is less than said second input;

said low threshold voltage comparator having a first input, said first input including means operatively connected to the operative connection of said probe circuit and to said output of said resistor, a second input operatively connected to the output of said second voltage reference, an output and means for generating a signal at said output when said first input is greater than said second input;

means for periodically generating a clock signal operatively connected to said high threshold voltage comparator and said low threshold voltage comparator; and means for determining whether an output signal is simultaneously present on both said high threshold voltage comparator and said low threshold voltage comparator during presence of said clock signal 5. A coin testing circuit comprising:

means for generating a square wave voltage of substantially constant frequency and amplitude, said means having an output;

a resistor having an output and an input, said input being operatively connected to the output of said means for generating a square wave voltage;

a probe tank circuit including a capacitor and an inductor connected in parallel to each other, said inductor being positioned in magnetic field relationship with a coin to be tested, said probe tank circuit having a first operative connection to the output of said resistor and a second operative connection to ground, said first operative connection having an oscillatory output voltage frequency equal to the frequency of said square wave input and a peak to peak voltage which is a function of the characteristics of the coin under test;

means for generating a direct current voltage output correlated in value to the peak to peak amplitude of the voltage, said means being directly connected at the first operative connection of said probe tank circuit to the output of said resistor;

window detection means for determining whether said direct current voltage output has a value less than a first predetermined voltage value and greater than a second predetermined voltage value at a given instant of time, said means including a high threshold voltage comparator, a low threshold voltage comparator, a first voltage reference having an output of substantially constant value equal to said first predetermined voltage value, and a second voltage reference having an output of substantially constant value equal to said second predetermined voltage value;

said high threshold voltage comparator having a voltage follower amplifier having an input operatively connected to the output of said means for generating a direct current output, said voltage follower amplifier having an output, a comparator having a first input operatively connected to the output of said voltage follower amplifier and a second input operatively connected to the output of said first voltage reference, an output and means for generating a signal at said output when said first input is less than said second input;

said low threshold voltage comparator having a voltage follower amplifier having an input operatively connected to the output of said means for generating a direct current output, said voltage follower amplifier having an output, a comparator having a first input operatively connected to the output of said voltage follower amplifier, a second input operatively connected to the output of said second voltage reference, an output and means for generating a signal at said output when said first input is greater than said second input;

means for periodically generating a clock signal operatively connected to said high threshold voltage comparator and said low threshold voltage comparator; and means for determining whether an output signal is simultaneously present on both said high threshold voltage comparator and said low threshold voltage comparator during presence of said clock signal.

6. A coin testing circuit comprising:

means for generating a square wave voltage of substantially constant frequency and amplitude, said means having an output;

a resistor having an output and an input, said input being operatively connected to the output of said means for generating a square wave voltage;

a probe tank circuit including a capacitor and an inductor connected in parallel to each other, said inductor being positioned in magnetic field relationship with a coin to be tested, said probe tank circuit having a first operative connection to the output of said resistor and a second operative connection to ground, said first operative connection having an oscillatory output voltage frequency equal to the frequency of said square wave input and a peak to peak voltage amplitude which is a function of the characteristics of the coin under test;

means for generating a direct current voltage output correlated in value to the peak to peak amplitude of the voltage, said means being directly connected at the first operative connection of said probe tank circuit to the output of said resistor;

first means for determining whether said direct current voltage output has a value less than a first predetermined voltage value and greater than a second predetermined voltage value at a particular time; and second means for determining whether said direct current voltage output has a value less than a third predetermined voltage value and greater than a fourth predetermined voltage value at said particular time.

* * * * *